US005952290A

United States Patent [19]

Li et al.

[11] Patent Number: 5,952,290

[45] Date of Patent: Sep. 14, 1999

[54] ANIONIC GEMINI SURFACTANTS AND METHODS FOR THEIR PREPARATION

[75] Inventors: Ruoxin Li; David James Tracy, both of Plainsboro, N.J.

[73] Assignee: Rhodia Inc., Cranbury, N.J.

[21] Appl. No.: 08/979,296

[22] Filed: Nov. 26, 1997

[51] Int. Cl.[6] ..... C11D 9/00; C11D 3/38; C11D 1/00; C11D 10/00

[52] U.S. Cl. ..... 510/493; 510/467; 510/492; 510/494; 510/501; 510/506; 510/536; 554/97

[58] Field of Search ..... 510/490, 493, 510/492, 501, 505, 506, 494, 467; 554/536, 97

[56] References Cited

U.S. PATENT DOCUMENTS

| | | | |
|---|---|---|---|
| 4,936,551 | 6/1990 | Behler et al. | 260/400 |
| 5,160,450 | 11/1992 | Okahara et al. | 252/174.21 |
| 5,487,778 | 1/1996 | Kaiser | 106/287.23 |
| 5,493,050 | 2/1996 | Varadaraj et al. | 562/41 |
| 5,507,863 | 4/1996 | Kaiser | 106/20 |
| 5,643,864 | 7/1997 | Li et al. | 510/499 |
| 5,789,371 | 8/1998 | Tracy et al. | 510/490 |

FOREIGN PATENT DOCUMENTS

| | | |
|---|---|---|
| 42 32 414 | 3/1994 | Germany . |
| 4401565 | 7/1995 | Germany . |
| PCT/JP93/00811 | 7/1993 | Japan . |
| PCT/93/25646 | 12/1993 | Japan . |
| 1503280 | 3/1978 | United Kingdom . |

OTHER PUBLICATIONS

Rosen, M. Geminis: A New Generation of Surfactants Chemtech 30–33 Mar. (1993).

Stapersma et al. Hydroxyalkane Sulfonate, a New Surfactant based on Olefins JAOCS 69; No. 1, (1992) 39–43.

Herke et al. Addition of Bisulfite to α–olefins: Synthesis of n–Alkane Sulfonates; JAOCS; 69, No. 1 (1992) 47–51.

Jiang et al. The Effect of Hydrophobic–Lipophilic Interactions on Chemical Reactivity. J. Am. Chem. Soc. 106 (1984) 7202–7205.

Vold, M. Micellization, Some Properties of Dimers of Na–Octyl Sulfates; J. Colloid and Interface Sci; 135 No. 2 (1990) 520–530.

Menger et al. Binding Properties of 1–Pyrenesulfonic Acid in Water. J. Org. Chem.Soc. 52 No. 17 (1987) 3793–98.

Neumann et al. The Interaction of Cationic Dyes with Anionic Surfactants in the Premicellar Region. J. Colloid and Interface Sci. 135; No. 1 (1990) 209–217.

Cheng et al. Facial Amphiphiles. J. Am. Chem. Soc. 144 No. 18 (1992) 7319–20.

Jaeger et al. Double–Chain Surfactants with Two Carboxylate Head Groups That Form Vesicles. Langmuir, 12 No. 8; (1996) 1976–80.

Okano et al. α–Sulfonated Fatty Acid Esters JAOCS 73 No. 1 (1996) 31–37.

Zhu et al. Preparation and Properties of Double Chain Surfactants Bearing Two Sulfonate Groups. Jpn. Oil Chem. Soc. 40 vol. 6 (1991) 473–477.

Zhu et al. Preparation and Surface Active Properties of New Amphipathic Compounds with Two Phosphate Groups and Two Long Chain Alkyl Groups. JAOCS; 68 No. 4, (1991) 268–71.

Paubert et al. Sulphonates Derived from Dimer Acids and Esters. Tenside Surf. Det. 32 No. 1 (1995) 36–44.

Furhop et al. Bolaamphiphiles and Monolayer Lipid Membranes; J. Am. Chem. Soc. 108 No. 8 (1986) 1785–91.

Ikeda et al. Re–examination of Aggregation Behavior of Disodium 1,12–Dodecane Disulfate. J. Colloid and Interface Sci 130 No. 1 (1989) 290–91.

Rosen et al. Relationship of Structure to Properties of Surfactants: LDS JAOCS 69 N O.1 (1992) 30–33.

(List continued on next page.)

*Primary Examiner*—Yogendra Gupta
*Assistant Examiner*—John M Petruncio
*Attorney, Agent, or Firm*—Craig M. Bell

[57] ABSTRACT

The present invention comprises a new, improved class of anionic gemini surfactants consisting of two hydrophilic groups and two hydrophobic moieties joined by a bridge that possess improved surfactant functionalities yet may be characterized as mild for use in personal care products and environmentally benign. These compounds may be represented by the general structural formula as follows:

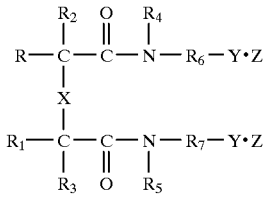

wherein R, $R_1$, $R_2$, and $R_3$ are selected from the group consisting of straight or branched chain $C_1$ to $C_{22}$ alkyl, aryl or hydrogen, and each R moiety can be the same or different; $R_4$ and $R_5$ are selected from the group comprising a straight or branched chain $C_1$ to $C_6$ alkyl with the further proviso that when either is a $C_6$ it may exist as a cyclohexyl ring; $R_6$ and $R_7$ are selected from the group consisting of straight or branched chain $C_2$ to $C_6$ alkyl or aryl with the further proviso that $R_6$ and $R_7$ may be the same or different and wherein X is selected from the group comprising —S—, —S—S—, —$D_1$—$R_8$—D— or —$R_8$—$D_1$—$R_8$— wherein $R_8$ is a straight or branched chain $C_1$ to $C_{10}$ alkyl or aryl and $D_1$ is selected from the group consisting of —O—, —S—, —S—S—, —$SO_2$—; Y is —$PO_4$ or —$SO_3$ and can be the same or different and Z is selected from the group consisting of Na, K, alkali or alkaline earth metals, ammonium, their salts and mixtures thereof.

20 Claims, No Drawings

OTHER PUBLICATIONS

Zhu et al. Preparation and Surface Active Properties of Amphipathic Compounds with Two Sulfate Groups and Two Lipophilic Alkyl Chains. JAOCS 67 No. 7 (1990) 459–463.
Zhu et al. Synthesis and Properties of BIS (Sulfonate) Types of Double Chain Surfactants. J. Jpn. Oil Chem. Soc. 42 No. 2 (1993) 86–94.
Zhu et al. Preparation and Properties of Glycerol Based Double or Triple Chain Surfactants with Two Hydrophilic Ionic Groups. JAOCS 69; No. 7 1992) 626–632.
Zhu et al. Preparation and Properties of Double or Triple Chain Surfactants with Two Sulfonate Groups. JAOCS; 68 No. 7 1991) 539–543.
Stein et al. Synthesis and Aggregation Properties of a New Family of Amphiphiles with Unusual Headgroups. J. Am. Chem. Soc. 114 No. 10; (1992) 3943–3950.
Zhu et al. Double–Chain Surfactants with Two Carboxylate Groups and Their Relation to Similar Double–Chain Compounds J. Colloid and Interface Sci. 158 (1993) 40–45.
Okahara et al. Surface Active Properties of New Types of Amphiphatic Compounds with Two Hydrophilic Ionic Groups and Two Lipophilic Alkyl Chains J. Jpn. Oil Chem. Soc. 37; No. 9 (1988) 746–747.
Ono et al. Preparation and Properties of BIS (Sodium Carboxylate) Types of Cleavable Surfactants Derived from Diethyl Tartrate and Fatty Carbonyl Compounds J. Jpn. Oil Chem. Soc. 42 No. 1 (1993) 10–16.
Gao et al. Dynamic Surface Tension of Aqueous Surfactant Solutions.6.JAOCS 71 No. 7 (1994) 771–776.
Masuyama et al. Synthesis and Properties of BIS (Taurine) Types of Double Chain Surfactants J. Jpn. Oil Chem. Soc. 41 No. 4 (1992) 13–17.
Kida et al. A Facile Synthesis of Polyglycidyl Ethers from Polyols and Epichlorohydrin. Synthesis (May. 1993) 487–489.
Tanaka et al. Double Chain Surfactant as a New and Useful Micelle Reagent for Electrokinetic Chromatography J. Chromatogr. 648 (1993) 469–473.

ANIONIC GEMINI SURFACTANTS AND METHODS FOR THEIR PREPARATION

This invention relates to a novel group of anionic surfactants having at least two hydrophobic moieties and at least two hydrophilic groups per molecule useful as emulsifiers, detergents, dispersants, hydrotropes, wetting agents, corrosion inhibitors and solubilizing agents.

BACKGROUND OF THE INVENTION

Surfactants are well known materials which can be generally described as having a hydrophobic moiety and a hydrophilic group per molecule. A wide variety of these materials are known and are classified as anionic, cationic, nonionic and amphoteric. They are well known to have numerous uses such as emulsifiers, detergents, dispersants and solubilizing agents in the field of cosmetics, textile treatment, industrial and personal cleaning preparations, corrosion inhibitors and the like.

Emulsification in particular is an extremely important technology and property of surfactants and it is a process which is used in detergency, emulsion polymerization, cosmetics, food, agrochemicals, paints, paper, transportation of crude oil, etc. Emulsifiers function as essential ingredients in personal care and household products; industrial and institutional cleaners including hair shampoos, car wash detergents, carpet shampoos, hand dishwashing liquids, latex foaming and oil recovery compositions; and the like.

In order to form a relatively stable emulsion, an emulsifier is required to adsorb at an oil-water interface to prevent emulsion droplet coalescence. The majority of emulsifiers are synthetic surfactants or natural products with amphiphilic characteristics. Presently, usage levels of surfactants that are necessary for effective emulsification are usually above 0.1% active based on the total weight of the detergent solution used in the final composition. For a given emulsifier system, it would obviously be advantageous to be able to use a lower amount of surfactant in order to reduce the cost of the surfactant and amount of surfactant waste discharged into the environment, while at the same time improving the performance of the final products [e.g., improving film forming and water resistance in latex paints and reducing skin irritation in cosmetic products].

Surfactants generally are compounds having one hydrophilic group and one hydrophobic moiety. Recently, a group of compounds having two hydrophobic moieties and two hydrophilic groups have been introduced. These have become known as "gemini surfactants" in the literature (*Chemtech,* March 1993, pp 30–33), and *J. Am. Chem. Soc.,* 115, 10083–10090, (1993) and the references cited therein. Since their introduction, cationic and anionic "gemini surfactants" have been disclosed. Other surfactant compounds having two hydrophilic groups and two hydrophobic moieties have been disclosed but not referred to as gemini surfactants.

It has been found that gemini surfactants are unexpectedly effective emulsifiers when used at very low concentrations in comparison to conventional surfactants. This finding is reflected in their ability to afford superior detergency at very low concentrations. Other performance properties related to emulsification as mentioned above can be also improved using low concentrations of gemini surfactants.

The novel surfactant compounds of the invention are based on certain gemini surfactants. As used herein, the term "gemini surfactants" is intended to mean surfactants having at least 2 hydrophobic groups and at least 2 hydrophilic groups per molecule.

A number of the gemini surfactants are reported in the literature, see for example, Okahara et al., J. Japan Oil Chem. Soc. 746 (1989); Zhu et al., 67 JAOCS 7,459 (July 1990); Zhu et al., 68 JAOCS 7,539 (1991); Menger et al., J. Am. Chem. Soc. 113, 1451 (1991); Masuyama et al., 41 J. Japan Chem. Soc. 4,301 (1992); Zhu et al., 69 JAOCS 1,30 (January 1992); Zhu et al., 69 JAOCS 7,626 (July 1992); Menger et al., 115 J. Am. Chem. Soc. 2, 10083 (1993); Rosen, Chemtech 30 (March 1993); and Gao et al., 71 JAOCS 7,771 (July 1994), all of this literature being incorporated herein by reference.

Also, gemini surfactants are disclosed by U.S. Pat. No. 2,374,354 to Kaplan; U.S. Pat. Nos. 2,524,218 and 2,530,147 to Bersworth (two hydrophobic tails and three hydrophilic heads); U.S. Pat. No. 3,244,724 to Guttmann; and U.S. Pat. No. 5,160,450, to Okahara, et al., all of which are also incorporated herein by reference.

The gemini surfactants may also be anionic, nonionic, cationic or amphoteric. The hydrophilic and hydrophobic groups of each surfactant moiety may be any of those known to be used in conventional surfactants having one hydrophilic group and one hydrophobic group. For example, a typical nonionic gemini surfactant, e.g., a bis-polyoxyethylene alkyl ether, would contain two polyoxyethylene alkyl ether moieties. However, non-ionic gemini surfactants prior to this are extremely rare. Anionic gemini surfactants carry a negative charge on the hydrophilic portion, usually in the form of a carboxylate, phosphate, sulfate or sulfonate.

Gemini surfactants are relatively quite new and few species have been reported or disclosed in the prior art. U.S. Pat. No. 5,534,197 to Scheibel teaches a method for the preparation of a nonionic gemini surfactant wherein the hydrophilic head is a sugar or carbohydrate while the hydrophobic head is a long chain alkyl, the two being joined by a short alkyl chain. U.S. Pat. Nos. 3,888,797 and 3,855,156, both to Marumo, disclose a number of nonionic gemini surfactant species in which the hydrophobic portion is comprised of a long chain lower alkyl or alkene while the hydrophilic portion is comprised of an ethoxylate group. U.S. Pat. No. 4,892,806 to Briggs and European Patent No. 0,688,781A1 to Adams also disclose sugar-based hydrophilic heads joined to the hydrophobic counterpart by a short chain carbon bridge.

Sulfate, phosphate, and carboxylate surfactants are currently disclosed in the literature (See JAOCS 67, 459 (1990); JAOCS 68, 268 (1991); JAOCS 68, 539 (1991); and JAOCS 69, 626 (1992). In each case, a secondary hydroxyl is sulfated, carboxylated, or phosphated.

Secondary hydroxyl's phosphate poorly in that phosphoric anhydride leads to olefin production (dehydration) while polyphosphoric acid results in high levels of phosphoric acid and unphosphated material. The present invention results in compounds which are characterized by primary hydroxyl groups which can more efficiently be functionalized.

Similarly, sulfation can also lead to dehydration by-products. Carboxymethylation of secondary hydroxyl groups is also difficult resulting in low yields.

One author [J. Am. Chem. Soc. 115, 10,083 (1993) and J. Am. Chem. Soc. 113, 1451 (1991)] prepares a phosphate moiety on a primary hydroxyl group. But in these references, it is necessary to utilize mixed alcohols in order to incorporate a hydrophobe into the molecule. This leads to the production of mixed diphosphates, a necessary outgrowth of using the mixed alcohols. This difficulty is eliminated in the present invention. In addition, high monoalkylphosphates as well as diphosphates can be prepared according to the present invention.

Due to the need for new and more effective and efficient surfactants, as well as the need for mild surfactants which are biologically compatible in an ecologically sensitive environment, effort has been made to develop a new class of compounds which demonstrate improved surface-active properties that are further characterized as mild and environmentally benign.

SUMMARY OF THE INVENTION

The present invention comprises a new, improved class of anionic gemini surfactants consisting of two hydrophilic groups and two hydrophobic moieties joined by a bridge that possess improved surfactant functionalities yet may be characterized as mild for use in personal care products and environmentally benign. These compounds may be represented by the general structural formula as follows:

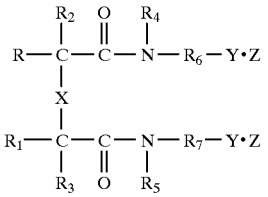

wherein R, $R_1$, $R_2$, and $R_3$ are selected from the group consisting of straight or branched chain $C_1$ to $C_{22}$ alkyl, aryl or hydrogen, and each R moiety can be the same or different; $R_4$ and $R_5$ are selected from the group comprising a straight or branched chain $C_1$ to $C_6$ alkyl with the further proviso that when either is a $C_6$ it may exist as a cyclohexyl ring; $R_6$ and $R_7$ are selected from the group consisting of straight or branched chain $C_2$ to $C_6$ alkyl or aryl with the further proviso that $R_6$ and $R_7$ may be the same or different and wherein X is selected from the group comprising —S—, —S—S—, —$D_1$—$R_8$—$D_1$ or —$R_8$—$D_1$—$R_8$— wherein $R_8$ is a straight or branched chain $C_1$ to $C_{10}$ alkyl or aryl and $D_1$ is selected from the group consisting of —O—, —S—, —S—S—, —$SO_2$—; Y is —$PO_4$ or —$SO_3$ and can be the same or different and Z is selected from the group consisting of Na, K, alkali or alkaline earth metals, ammonium, their salts and mixtures thereof.

DETAILED DESCRIPTION OF THE INVENTION

The novel anionic gemini surfactants of the present invention are essentially comprised of two hydrophilic "heads" and two hydrophobic "tails" joined by a bridge consisting of sulfur, oxygen and disulfoalkyl or dioxyalkyl. These exhibit superior micelle-forming and surface tension lowering properties. The surfactants may be classified generally as a group of taurinates characterized by the formula:

I

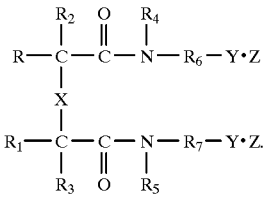

wherein R, $R_1$, $R_2$, and $R_3$ are selected from the group consisting of straight or branched chain $C_1$ to $C_{22}$ alkyl, aryl or hydrogen and each R–$R_3$ of the moieties can be the same or different; $R_4$ and $R_5$ are selected from the group comprising a straight or branched chain $C_1$ to $C_6$ alkyl with the further proviso that when either is a $C_6$ it may exist as a cyclohexyl ring; $R_6$ and $R_7$ are selected from the group consisting of straight or branched chain $C_2$ to $C_6$ alkyl or aryl with the further proviso that $R_6$ and $R_7$ may be the same or different and wherein X is selected from the group comprising —S—, —S—S—, —$D_1$—$R_8$—$D_1$ or —$R_8$—$D_1$—$R_8$— wherein $R_8$ is a straight or branched chain $C_1$ to $C_{10}$ alkyl or aryl and $D_1$ is selected from the group consisting of —O—, —S—, —S—S—, —$SO_2$—; Y is —$PO_4$ or —$SO_3$ and can be the same or different and Z is selected from the group consisting of Na, K, alkali or alkaline earth metals, ammonium, their salts and mixtures thereof.

More specifically, preferred anionic gemini surfactants of the present invention may be structurally represented as follows:

II

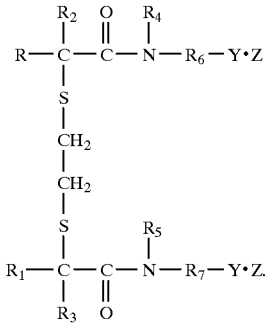

wherein R, $R_1$, $R_2$, $R_3$, $R_4$, $R_5$, $R_6$ and $R_7$ have been hereinbefore defined, Y is —$SO_3^-$ and Z is $Na^{+\cdot}$ Other anionic gemini surfactants contemplated as falling within the scope of the present invention may be represented by the structure:

III

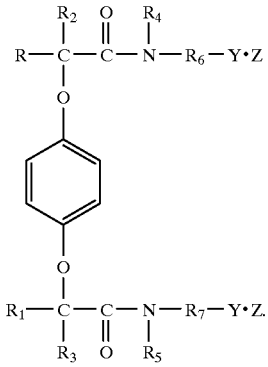

wherein R–$R_7$ have been hereinbefore defined and Y is $SO_3^-$ and Z is $Na^{+\cdot}$ A fourth anionic gemini surfactant falling within the scope of the present inventors is represented by the structural formula:

IV

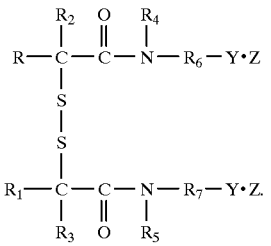

wherein R–$R_7$, Y and Z have been hereinbefore defined.

The anionic gemini surfactants in which the two hydrophobic/hydrophilic chains are bridged with oxygen or sulfur containing bridges may be synthesized as follows. These reaction protocols may be used to synthesize a wide variety of compounds such as propylenedithio-, ethylenedithio-, butylenedithio-gemini surfactants and thio-bis taurinates. Initially, an intermediate is produced by reacting α-bromolauric acid chloride with sodium taurinate/sodium carbonate. The reaction may be structurally represented as follows:

A

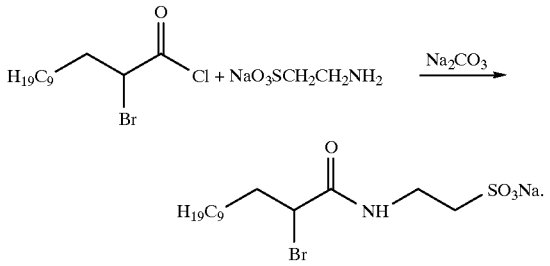

The intermediate A is then coupled through bridging two groups through the addition of ethanedithiol in an aqueous methanol solution.

A]

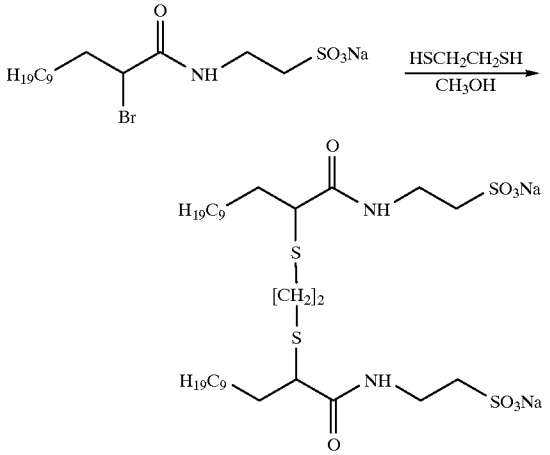

Another means for preparing the gemini surfactants of the present invention is by linking the intermediate A moieties discussed above with hydroquinone in the presence of sodium carbonate as follows:

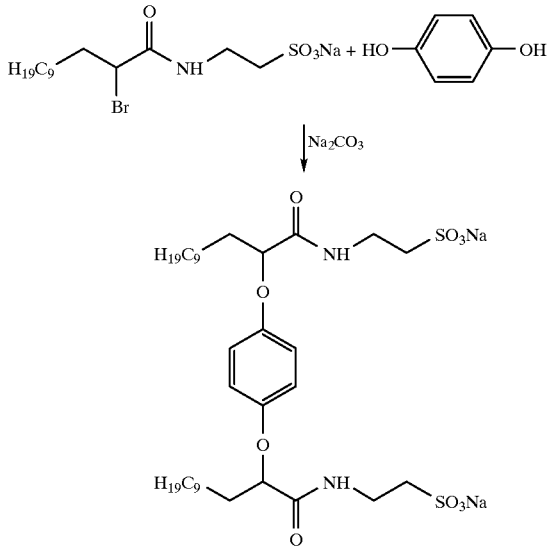

Whereas the surfactants of the invention can be used alone as the essential hydrotrope component, it has been unexpectedly found that blends of the compounds of the invention with certain conventional well known anionic, nonionic, cationic and amphoteric surfactants provide results beyond that expected and are therefore synergistic, a phenomenon that can be demonstrated in terms of critical micelle concentration and surface tension reducing ability.

Examples of the nonionic surfactants used herein include fatty acid glycerine esters, sorbitan fatty acid esters, sucrose fatty acid esters, polyglycerine fatty acid esters, higher alcohol ethylene oxide adducts, single long chain polyoxyethylene alkyl ethers, polyoxyethylene alkyl allyl ethers, polyoxyethylene lanolin alcohol, polyoxyethylene fatty acid esters, polyoxyethylene glycerine fatty acid esters, polyoxyethylene propylene glycol fatty acid esters, polyoxyethylene sorbitol fatty acid esters, polyoxyethylene castor oil or hardened castor oil derivatives, polyoxyethylene lanolin derivatives, polyoxyethylene fatty acid amides, polyoxyethylene alkyl amines, an alkylpyrrolidone, glucamides, alkylpolyglucosides, mono- and dialkanol amides, a polyoxyethylene alcohol mono- or diamides and alkylamine oxides. Examples of the anionic surfactants used herein include fatty acid soaps, ether carboxylic acids and salts thereof, alkane sulfonate salts, α-olefin sulfonate salts, sulfonate salts of higher fatty acid esters, higher alcohol sulfate ester salts, fatty alcohol ether sulfates salts, higher alcohol phosphate ester salts, fatty alcohol ether phosphate ester salts, condensates of higher fatty acids and amino acids, and collagen hydrolysate derivatives.

Examples of the cationic surfactants used herein include alkyltrimethylammonium salts, dialkyldimethylammonium salts, alkyldimethylbenzylammonium salts, alkylpyridinium salts, alkylisoquinolinium salts, benzethonium chloride, and acylamino acid type cationic surfactants.

Examples of the amphoteric surfactants used herein include amino acid, betaine, sultaine, phosphobetaines, imidazoline type amphoteric surfactants, soybean phospholipid, and yolk lecithin.

Any of the commonly used auxiliary additives such as inorganic salts such as Glauber salt and common salt, builders, humectants, solubilizing agents, UV absorbers, softeners, chelating agents, and viscosity modifiers may be added to the surfactants of the invention or blends thereof with other surfactants as disclosed herein.

The anionic surfactants of the invention are extremely mild and non-irritating to both eyes and skin. They also exhibit enhanced wetting speed, greater surface tension reduction, high foaming and foam stabilization properties, low toxicity, and excellent compatibility with other anionic, cationic, and nonionic surfactants. They show unique performance attributes i.e., superior solubilization of co-ingredients, stabilization of enzymes and the enhanced removal of stains. The products of the invention are stable over a wide pH range and are biodegradable. These properties make these surfactants adaptable for use in products ranging from cosmetics to industrial applications and are usable wherever anionic surfactants have found use. These products are particularly useful for non-irritating shampoos, including baby shampoos, body shampoos including bubble baths, bar soaps, bath gels, hair conditioning gels, lotions, skin creams and lotions, make up removal creams and lotions, liquid detergents, dish detergents, and other washing and cosmetic products that contact the skin. The surfactants of the invention can also find use as hard surface cleaners including cars, dishes, toilets, floors, and the like; laundry detergents and soaps, metal working aids and the like. They are also compatible with bleaching agents and are able to stabilize enzymes and enhance the removal of oily soils in detergent systems.

The following examples are presented to more specifically set forth how to prepare the novel anionic gemini surfactants as well as their superior surface-active characteristics. They are for illustrative purposes only and it is recognized that minor changes may be made to the reactants and the reaction parameters that are not contemplated or specifically disclosed herein. It is to be further understood that to the extent any such changes do not materially affect the composition of the final product and the surface active functionalities possessed thereby, such changes are considered as falling within the spirit and scope of the invention as later recited by the claims.

EXAMPLE 1

Preparation of Thiobis Taurinate I

A. Preparation of Intermediate A

A]

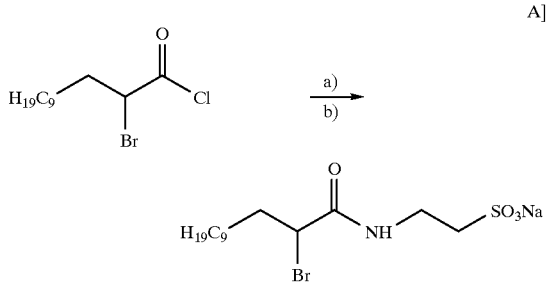

a) $NaO_3SCH_2CH_2NH_2$
b) $Na_2CO_3$

α-Bromolauric acid chloride (20 gm., 67.3 mmol) was added dropwise to a saturated sodium taurinate/sodium carbonate solution at 5° C. The solution became cloudy immediately. The reaction temperature was allowed to warm up to room temperature and the reaction was stirred for 5 hours. The final white powder product was collected by filtration. After drying under vacuum, the final product was taken for Nuclear Magnetic Resonance (NMR) analysis. The NMR spectrum generated agreed with the expected structure of the final product. The yield of the reaction was about 95%.

B. Coupling Reaction

A]

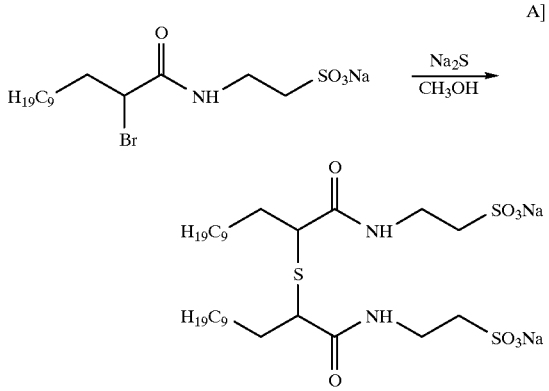

Sodium sulfide (2 gm., 8.33 mmol) was dissolved in a methanol/water solution. Intermediate compound A (4.0 gm., 9.8 mmol) was then added to the solution. The reaction mixture was refluxed for 3–4 hours at 79° C. The reaction was then stopped by cooling the solution to room temperature. A white solid material was collected by filtration. After washing with cool ethanol, the material was dried under vacuum and taken for NMR analysis. The NMR spectra results showed that this material was the expected product. The yield of the reaction was about 90%.

EXAMPLE 2

Preparation of Dithio Derivative II

A]

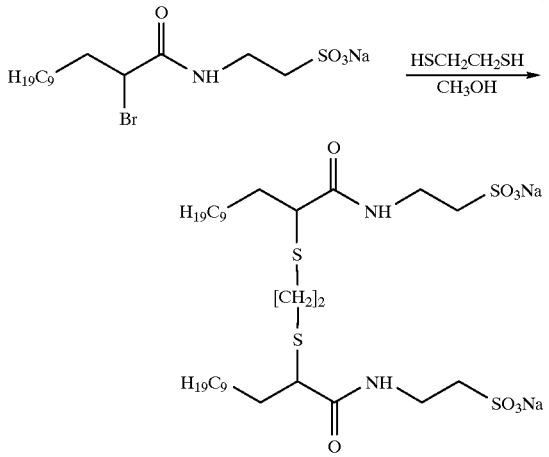

Intermediate A compound (8.0 gm., 19.6 mmol) was dissolved in methanol and this was added to a solution of ethylenedithiol [1.0 gm., 9.6 mmol] in methanol. Excess sodium carbonate was added to the solution. The reaction was refluxed for a few hours and then stopped by cooling it to room temperature. The crude product was extracted twice with η-butanol, followed by the collection of the organic layer which was then rotoevaporated under reduced pressure. The remaining material was washed with ethanol once. The final powder material was collected by filtration and then taken for NMR analysis. The NMR results agreed with the expected structure of the product. The yield was about 82%.

EXAMPLE 3

Preparation of Ether Linked Derivative III

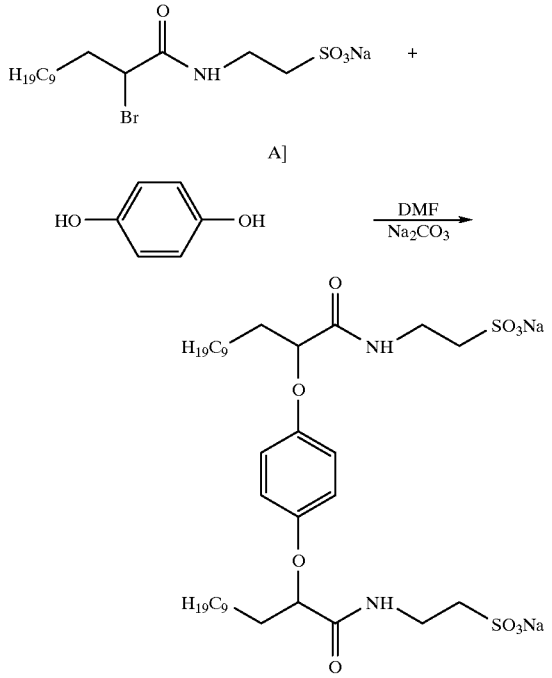

Intermediate compound A [16.0 gm., 39.2 mmol] and hydroquinone [2.0 gm., 18.2 mmol] were dissolved in dry dimethyl formamide [DMF] at room temperature. Excess sodium carbonate was then added to the solution. The reaction was stirred for 15 hours at 85° C. and then stopped by cooling to room temperature. The crude product was extracted twice with η-butanol and the organic layer was collected and rotoevaporated under reduced pressure. The remaining material was washed with methanol and the organic layer was collected and evaporated under reduced pressure. The final remaining material was dried under vacuum and then analyzed by NMR. NMR results agreed with the expected structure of the product while the yield was about 70%.

EXAMPLE 4

Surfactant Surface Properties

The surfactants of the invention were measured for critical micelle concentration and their ability to reduce surface tension.

The test methods utilized are described as follows:

Critical Micelle Concentration (CMC)

Aqueous solutions of each surfactant were prepared at varying concentrations. The surface tension at 20° C. were measured by the Wilhelmy plate method and plotted vs. the logarithm of the concentration. The critical micelle concentration was determined as the value at which the slope of the line changed abruptly.

Surface Tension Reducing Ability [gamma CMC]

The surface tension reducing ability was determined from the surface tension of the surfactant that exists at the critical micelle concentration.

Surface tension measurements were made for each of the referenced surfactants, using a Kruss K-12 Tensiometer [plate method]. Each experiment was carried out as follows:

Distilled water solutions at different concentrations were prepared for each of the test surfactants in 100 mL amounts. The mixtures were stirred until homogeneous solutions were obtained. The surface tensions of these solutions were then measured.

From the surface tension data, the area/molecule [area] at the interface and efficiency of adsorption were computer by use of the appropriate Gibb's Adsorption Equation:

$$\rho = \frac{-d\gamma}{d\log C_T} \Big/ 2.303RT$$

where

ρ=surface excess concentration [mol/cm$^2$]

dγ=change in surface or interfacial tension of the solvent [dyne cm$^{-1}$]

R=8.31×10$^7$ erg mol$^{-1}$ K$^{-1}$

C=molar concentration of solution

T=absolute temperature [°K]

pC-20 at the solution/air interface is defined as the negative logarithm of the surfactant concentration required to lower surface tension by 20 dyne/cm.

The results obtained for the surfactants alone are reported in Table I.

TABLE I

Surface Activity

| Surfactant | cmc [M] |
|---|---|
| Example 1 | $3.98 \times 10^{-6}$ |
| Example 2 | $1.99 \times 10^{-6}$ |
| N-Methylcocotaurinate* | $3.16 \times 10^{-5}$ |
| (Coco $N(CH_3)CH_2CH_2SO_3Na$) | |

*Conventional anionic single chain surfactant - Geropon ® TC42.

When the surface properties for the anionic sulfonate compounds of the present invention are compared to the corresponding conventional anionic species such as N-methylcocotaurinate as shown in Table I, the novel compounds of the present invention show unexpected surface active properties and unusually low critical micelle concentration [cmc] values in aqueous media. This property is a measure of the tendency of the surfactant to form micelles, and adsorb at the interface, and consequently, to reduce surface tension. The values shown in Table I demonstrate that the sulfonates are one to two orders of magnitude [or 10 to 100 times] more effective at forming micelles. This unusually high surface activity for these molecules is a result of their unique structure; the presence of two optimally spaced hydrophobic moieties and hydrophilic groups. This molecular structure provides energetically favorable decreases in the free energy of adsorption and micellization through favorable distortion of the water structure, while simultaneously providing a "closed packed" arrangement at the interface as reflected by the unusually low area per molecule compared to that which would be expected from the molecular dimensions. The ability of the compounds of the invention to distort water structure through inhibition of crystalline or liquid crystalline phase formation in the bulk phase and at the same time to pack closely on adsorption at the interface is contrary to conventional wisdom. This again demonstrates the uniqueness of the molecular design for these compounds which is very critical to providing unexpected, exceptional surface and performance properties.

Exceptional surface activity and unique structural features for the compounds of the invention provide two other important performance properties that can have immense practical application in industry. They are hydrotropicity, which is the ability of organic substances to increase the solubility of other, insoluble organic substances in water and solubilization, the dissolving of water insoluble organic compounds into aqueous surfactant solutions above their critical micelle concentrations. The compounds of the invention, because of their very low cmc values, are efficient solubilizers. This latter property will not only allow the formulation of homogeneous water insoluble materials, but also will enhance the surface activity of other surfactants whose low water solubility restricts their use. These novel surfactants of the invention are far better than comparable conventional surfactants in hydrotroping and solubilizing properties.

Because of their unusually high surface activity coupled with their hydrotropicity and solubilization properties, compounds of this invention will provide exceptionally high performance properties, at very low concentration, in practical applications such as detergency emulsification, solubilization, dispersancy, hydrotropicity, foaming and wetting. Because of their greater surfactant efficiency as indicated by the extremely low cmc and pC-20 values, from 10 to 100 times lower concentrations of the compounds of the invention can be used compared to the invention than conventional surfactants, substantially reducing the need for the surfactant component to achieve equivalent results and thus reducing the amount of surfactant released into waste treatment facilities. Additionally, since the cmc is the maximum free surfactant concentration [that is, uncomplexed in micelles] under use conditions, this lower level of the active species should result in a much lower level of irritancy, even essentially none, if as is likely, it is below the irritancy threshold concentration.

Surface Activities of Mixtures

The unusually high surface activity of the anionic surface active agents of the invention make them the surfactants of choice in enhancing the surface activity of mixtures containing other conventional, significantly less surface active zwitterionic, amphoteric, nonionic and cationic surfactants. The anionic gemini surfactant compounds of the invention provide significant, unexpected improvement in the surface activity of blends of these compounds with the above types of surfactants, even when used in very small amounts. The improvement is beyond that which would be estimated from an average of the properties of the components of the surfactant mixture, hence showing positive synergism.

What we claim is:

1. An anionic surfactant composition comprising one or more compounds of the formula:

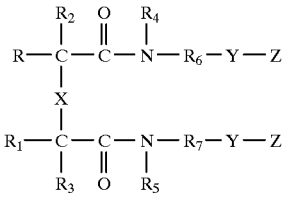

wherein R, $R_1$, $R_2$, and $R_3$ are selected from the group consisting of straight or branched chain $C_1$ to $C_{22}$ alkyl, aryl or hydrogen and each of the respective R moieties can be the same or different; $R_4$ and $R_5$ are selected from the group comprising a straight or branched chain $C_1$ to $C_6$ alkyl with the further proviso that when either is $C_6$ it can be a cyclohexyl ring; $R_6$ and $R_7$ are selected from the group consisting of straight or branched chain $C_2$ to $C_6$ alkyl or aryl with the further proviso that $R_6$ and $R_7$ may be the same or different, X is selected from the group comprising —S—, —S—S—, —$D_1$—$R_8$—$D_1$—, or —$R_8$—$D_1$—$R_8$— wherein $R_8$ is a straight or branched chain $C_1$ to $C_{10}$ alkylene or arylene and $D_1$ is selected from the group consisting of —O—, —S—, —S—S—, —$SO_2$; Y is $OPO_3$— or —$SO_3$ and can be the same or different and Z is selected from the group comprising Na, K, alkali or alkaline earth metals, ammonium, their salts and mixtures thereof.

2. The surfactant composition of claim 1 further comprising the structure:

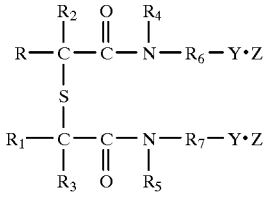

wherein R, $R_1$, $R_2$, $R_3$, $R_4$, $R_5$, $R_6$ and $R_7$ have been hereinbefore defined and Y is $SO_3^-$ and Z is $Na^{+\cdot}$

3. The surfactant composition of claim 1 further comprising the structure:

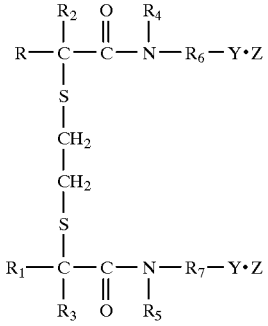

wherein R, $R_1$, $R_2$, $R_3$, $R_4$, $R_5$, $R_6$ and $R_7$ have been hereinbefore defined and Y is $SO_3^-$ and Z is $Na^{+\cdot}$

4. The surfactant composition of claim 1 further comprising the structure:

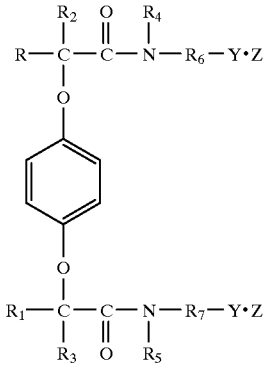

wherein R, $R_1$, $R_2$, $R_3$, $R_4$, $R_5$, $R_6$ and $R_7$ have been hereinbefore defined and Y is $SO_3^-$ and Z is $Na^{+\cdot}$

5. The surfactant composition of claim 1 further comprising the structure:

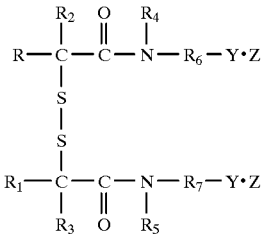

wherein R, $R_1$, $R_2$, $R_3$, $R_4$, $R_5$, $R_6$ and $R_7$ have been hereinbefore defined and Y is $SO_3^-$ and Z is $Na^+$.

6. A surfactant blend comprising one or more of the compounds of claim 1 and one or more additional compounds selected from the group consisting of anionic surfactants, nonionic surfactants, cationic surfactants, amphoteric surfactants, and mixtures thereof.

7. A surfactant blend comprising the compound of claim 2 and one or more additional compounds selected from the group consisting of anionic surfactants, nonionic surfactants, cationic surfactants, amphoteric surfactants, and mixtures thereof.

8. A surfactant blend comprising the compound of claim 3 and one or more additional compounds selected from the group consisting of anionic surfactants, nonionic surfactants, cationic surfactants, amphoteric surfactants, and mixtures thereof.

9. A surfactant blend comprising the compound of claim 4 and one or more additional compounds selected from the group consisting of anionic surfactants, nonionic surfactants, cationic surfactants, amphoteric surfactants, and mixtures thereof.

10. A surfactant blend comprising the compound of claim 5 and one or more additional compounds selected from the group consisting of anionic surfactants, nonionic surfactants, cationic surfactants, amphoteric surfactants, and mixtures thereof.

11. A cleaning composition comprising compounds of claim 1.

12. A cleaning composition comprising the compounds of claim 2.

13. A cleaning composition comprising the compounds of claim 3.

14. A cleaning composition comprising the compounds of claim 4.

15. A cleaning composition comprising the compounds of claim 5.

16. A cleaning composition comprising the surfactant blend of claim 6.

17. A cleaning composition comprising the surfactant blend of claim 7.

18. A cleaning composition comprising the surfactant blend of claim 8.

19. A cleaning composition comprising the surfactant blend of claim 9.

20. A cleaning composition comprising the surfactant blend of claim 10.

* * * * *